US006311404B1

(12) United States Patent
Smith

(10) Patent No.: US 6,311,404 B1
(45) Date of Patent: Nov. 6, 2001

(54) RETRACTABLE SAFETY MECHANISM AND COMPASS AND METHOD OF USING THE SAME

(76) Inventor: Paul A. Smith, 2311 Mohawk La., Glenview, IL (US) 60025

( * ) Notice: Subject to any disclaimer, the term of this patent is extended or adjusted under 35 U.S.C. 154(b) by 0 days.

(21) Appl. No.: 09/393,144

(22) Filed: Sep. 9, 1999

Related U.S. Application Data

(63) Continuation-in-part of application No. 09/183,064, filed on Oct. 30, 1998.

(51) Int. Cl.[7] ..... B43L 9/02
(52) U.S. Cl. ..... 33/27.02
(58) Field of Search ..... 33/27.02, 27.03, 33/27.031, 27.032, 27.033

(56) References Cited

U.S. PATENT DOCUMENTS

| | | | | |
|---|---|---|---|---|
| 375,257 | | 12/1887 | Boman . | |
| 710,242 | | 9/1902 | Bossart-Bachli . | |
| 729,717 | | 6/1903 | Beasley . | |
| 1,005,992 | * | 10/1911 | McMurray | 33/27.03 |
| 1,028,228 | | 6/1912 | Lampel . | |
| 1,127,346 | | 2/1915 | Bacon . | |
| 1,146,176 | * | 7/1915 | Lambert | 33/27.03 |
| 1,275,088 | | 8/1918 | Ramos . | |
| 1,769,477 | | 7/1930 | Thompson . | |
| 1,857,158 | | 5/1932 | Maloney . | |
| 2,041,299 | | 5/1936 | Neumayer . | |
| 2,442,185 | * | 5/1948 | Szerenyi | 33/27.02 |
| 2,518,977 | | 8/1950 | Conway . | |
| 2,637,906 | | 5/1953 | Giossi . | |
| 2,737,720 | * | 3/1956 | Käser | 33/27.03 |
| 3,308,538 | | 3/1967 | Peck . | |
| 3,550,282 | | 12/1970 | Tsunemi . | |
| 3,955,462 | | 5/1976 | Thorsman . | |
| 4,005,507 | | 2/1977 | Yamazaki . | |
| 4,173,076 | * | 11/1979 | Gossage | 33/27.02 |
| 4,561,184 | | 12/1985 | Fujitani . | |
| 4,815,881 | | 3/1989 | Chern . | |
| 5,090,127 | | 2/1992 | Shapiro et al. . | |
| 5,555,630 | * | 9/1996 | De Souza | 33/27.02 |

* cited by examiner

*Primary Examiner*—G. Bradley Bennett
(74) *Attorney, Agent, or Firm*—Patents & TMS, P.C.

(57) ABSTRACT

A compass assembly, a system and a method of using the compass assembly are provided. The compass assembly has a removable marking device attached to one of the legs. The other leg contains a retractable sleeve having a spring and engaging pin therein. In use, pressure is applied to the leg having the sleeve thereby pushing the engaging pin through a hole in the retractable sleeve thereby anchoring the compass and providing a point around which the compass may be spun. The marking device attached to the other leg of the compass may be removed to be changed, replaced or refilled. A marking device with various writing media, such as multiple colors or lead may be attached to the leg. Separate components of the compass may be distinctly colored to provide an instructional aid for using the compass.

20 Claims, 2 Drawing Sheets

RETRACTABLE SAFETY MECHANISM AND COMPASS AND METHOD OF USING THE SAME

This application is a continuation-in-part application of co-pending U.S. patent application Ser. No. 09/183,064, filed on Oct. 30, 1998.

BACKGROUND OF THE INVENTION

The present invention generally relates to a protection mechanism for an object having a sharp or pointed end. More specifically, the present invention relates to a retractable safety mechanism for use with an object having a sharp or pointed end, such as a pin or a compass, as well as a method of using the same.

It is, of course, generally known to provide pins for use on bulletin boards or the like for posting notes or signs, for example. Often, the pin dislodges from the surface to which the pin is attached and lays on the floor, for example, making the same dangerous if stepped on or if otherwise stuck by the pin.

In addition, pins and compasses are often utilized in classroom settings where children, for example, may be rather careless in their use. Such usage often creates dangerous conditions for other children or individuals who might be stuck by the pin or compass if the same was encountered.

Safety push pins are also known and described in, for example, U.S. Pat. No. 4,005,507 to Yamazaki. The push pin disclosed and described in Yamazaki is a two-piece construction having an upper shell with a large diameter hole having an inwardly flanged opening edge and a lower shell having a small diameter hole in the center of a bottom wall thereof. The head of the push pin has a diameter larger than the distance across the inwardly flanged edge. The pin extending from the head of the push pin is passable through the small diameter hole. An elastic member may be interposed between the upper and lower shells so that the space is normally open. The push pin disclosed, however, by Yamazaki, is rather complex and is often difficult to manufacture and to use due to its two-piece construction.

Similarly, compasses often have an engaging pin or point that is capable of engaging a marking surface around which the compass may pivot. The exposed pin or point of the compass may be dangerous to young children or adults. Additionally, compasses generally have a only a single marking device to trace out circles, arc or other marks when the compass is used.

A need, therefore, exists for an improved safety compass as well as a retractable safety mechanism usable therewith that overcomes the deficiencies of known devices that is simple to manufacture and easy to use.

SUMMARY OF THE INVENTION

The present invention provides a retractable safety mechanism and safety compass that prevents accidental sticking of an individual using the same or from accidental release or dropping of the same. The present invention further provides a compass having interchangeable marking devices. The present invention further provides a method of using the same.

To this end, in an embodiment of the present invention, a compass assembly is provided. The assembly has a first leg and a second leg connected to pivot with respect to each other and connected at a common endpoint wherein the first leg has a marking device and further wherein the second leg has an engaging pin. A sleeve having an interior space defined by walls is attached to the second leg. Further, the sleeve is extendable between a first position and a second position wherein the engaging pin of the second leg is capable of being enclosed in the interior space of the sleeve in the second position. A spring is in the interior space of the sleeve holding the sleeve in the second position.

In an embodiment, an aperture on an end of the sleeve is provided through which the engaging pin may extend.

In an embodiment, the first leg is a first color and the second leg is a second color.

In an embodiment, the marking device is a pencil.

In an embodiment, the marking device is a pencil having a plurality of leads.

In an embodiment, the marking device has an eraser at the common endpoint.

In an embodiment, the marking device is removable from the first leg.

In an embodiment, the compass assembly has a connecting means for removably attaching the marking device to the first leg.

In another embodiment of the present invention, a compass assembly is provided. Said compass assembly has a first leg and a second leg connected to pivot with respect to each other wherein the first leg has an interchangeable marking device having a plurality of marking tips and further wherein the second leg has an engaging pin. Further, the compass assembly has a sleeve having an interior space wherein the sleeve is extendable between a first position and a second position wherein the engaging pin of the second leg is enclosed in the interior space of the sleeve in the second position and further the compass assembly has a spring in the interior space of the sleeve holding the sleeve in the second position.

In an embodiment, the compass assembly has an aperture on an end of the sleeve through which the engaging tip is slidable.

In an embodiment, the interchangeable marking device is removably attached to the first leg.

In an embodiment, an eraser is attached to the compass assembly.

In an embodiment, the marking device has a plurality of types of pencil leads.

In an embodiment, the first leg is a first color, and the second leg is a second color distinct from the first color.

In an embodiment, a knob is attached to the compass assembly.

In another embodiment, a method for using a compass assembly is provided. Said method comprises providing a compass assembly having a first leg and a second leg connected to pivot with respect to each other wherein the first leg has a first marking device. Further, the method comprises providing an engaging pin on the second leg and providing a sleeve wherein the sleeve is extendable between a first position and a second position wherein the engaging pin is enclosed in the sleeve in the second position and further the compass assembly has a spring in the sleeve holding the sleeve in the second position. A marking surface is further provided. In addition, the method comprises placing the second leg having the engaging pin on the marking surface.

In an embodiment, the method comprises placing the first leg having the first marking device on the marking surface and spinning the compass to produce a mark on the marking surface.

In an embodiment, the method comprises providing a second marking device removably attached to the first leg.

In an embodiment, the method comprises removing the first marking device from the first leg and attaching the second marking device to the first leg.

It is, therefore, an advantage of the present invention to provide a compass assembly, a system and a method of using the compass assembly that prevents unwanted or accidental sticking during non-usage of the device.

Another advantage of the present invention is to provide a compass assembly, a system and a method of using the compass assembly that is simple to manufacture, simple to use and to provide safety during non-usage.

A still further advantage of the present invention is to provide a compass assembly, a system and a method of using the compass assembly that having a pin mechanism that retracts simply and without interference from the safety protective mechanism.

Yet another advantage of the present invention to provide a compass assembly, a system and a method of using the compass assembly having a retractable shield constructed and designed to prevent unnecessary removal from, for example, a marking surface or the like.

A still further advantage of the present invention is to provide a compass assembly, a system and a method of using the compass assembly having a protective shield that is constructed and designed to lock in an unprotected state for certain applications of usage.

Moreover, it is an advantage of the present invention to provide a compass assembly, a system and a method of using the compass assembly having a removable marking device.

Yet another advantage of the present invention is to provide a compass assembly, a system and a method of using the compass assembly having a second marking device of a color different than the first marking device capable of being attached to the compass.

A still further advantage of the present invention is to provide a compass assembly, a system and a method of using the compass assembly that safely allows the user to draw curves, arcs and circles in a plurality of colors.

A still further advantage of the present invention is to provide a compass assembly, a system and a method of using the compass assembly having an erasable end to correct mistakes.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
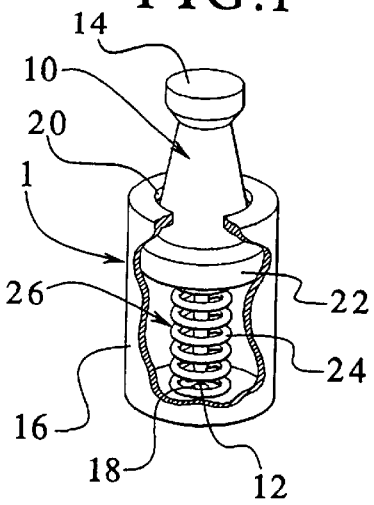
FIG. 1 illustrates a perspective view partially broken-away of an embodiment of a retractable push pin of the present invention.

Referring now to the drawings wherein like numerals refer to like parts, FIG. 1 illustrates a retractable push pin assembly 1. The assembly 1 includes a pin 10 having a pointed end 12 and an opposite end 14 for advancing the pointed end 12 into, for example, a bulletin board or the like. A sleeve 16 is provided to encase the pointed end 12 of the pin 10 when the pin 10 is not in use.

As illustrated, the sleeve 16 includes a first aperture 18 through which the pointed end 12 of the pin 10 extends when advanced through the first aperture 18. A second aperture 20 is provided such that a collar 22 of the pin 10 may be held in the position illustrated in FIG. 1 when the assembly 1 is not in use on, for example, a bulletin board. To this end, a spring 24 is incorporated within an interior space 26 formed by the outer walls of the sleeve 16. The spring 24 in a retracted position as illustrated in FIG. 1 prevents the pointed end 12 of the pin 10 from advancing through the first aperture 18.

Figure 2:
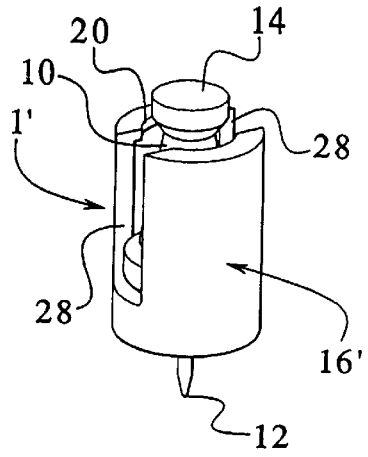
FIG. 2 illustrates a perspective view of an embodiment of a retractable push pin of the present invention.
Figure 3:
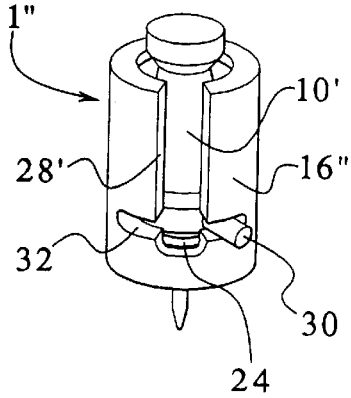
FIG. 3 illustrates a perspective of another embodiment of a retractable push pin of the present invention with a locking feature.

In a second position, as generally illustrated in FIGS. 2 and 3, or other embodiments of the assembly, the pin 10 is advanced such that the pointed end 12 extends through the first aperture of the sleeve 16.

A critical aspect of the present invention is the tensile strength of the spring 24. The tension of the spring 24 must be chosen such that when the push pin assembly 1 is not in use, the spring 24 forces the pin 10 to the position illustrated within the sleeve 16 shown in FIG. 1. Furthermore, the tensile strength of the spring 24 must be selected such that the spring 24 does not force removal of the pin 10 and the assembly 1 from, for example, a bulletin board or other device on which the assembly 1 is used.

Referring now to FIG. 2, another embodiment of a pin assembly 1' is shown. The assembly 1' is identical to the assembly 1 shown and illustrated with reference to FIG. 1 except a sleeve 16' is provided including at least one groove 28 extending longitudinally along the sleeve 16'. The groove 28 extends longitudinally along a length of the sleeve 16' from the aperture 20 to a point intermediate the length of the sleeve 16'. As shown, the groove 28 extends approximately three-quarters of the length of the sleeve 16'. The length of the groove 28 may be varied. Moreover, in a preferred embodiment, two grooves 28 may be incorporated on the sleeve 16' one-hundred eighty degrees apart from each other. The groove 28 or grooves keeps the pin 10 in alignment and reduces friction providing some "give" when the pin 10 advances and retracts within the sleeve 16' of the assembly 1'.

Referring now to FIG. 3, yet another embodiment of an assembly 1" is illustrated. Again, the assembly 1" is identical to the assemblies 1 and 1' shown in FIGS. 1 and 2, respectively. However, the assembly 1" illustrated in FIG. 3 includes a pin 10' having a button 30 extending therefrom. The button 30 is preferably integrally formed with the pin 10" and acts to lock the pin 10' in the advanced position shown and illustrated in FIG. 3.

To this end, a groove 28' similar to the groove 28 in FIG. 2 is provided with one or more perpendicularly extending grooves 32 in which the button 30 may engage and lock the pin 10' in the position illustrated in FIG. 3. One or more perpendicularly extending grooves 32 may be provided as required. In addition, a second groove (not shown) may be provided at another peripheral location on the sleeve 16", preferably one-hundred eighty degrees (180°) displaced from the first groove 28'. Still further, the button 30 may be depressable.

Figure 4:
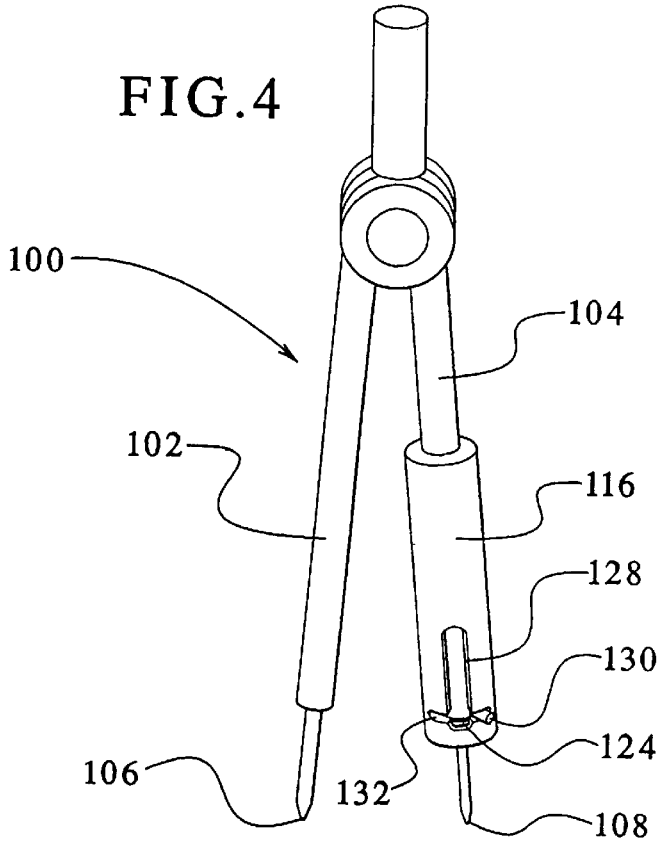
FIG. 4 illustrates a perspective view of an embodiment of a compass with a retractable shield and locking mechanism in an embodiment of the present invention.

Referring now to FIG. 4, another embodiment of a retractable sleeve 116 is shown and illustrated for incorporation and use with a compass 100. The compass 100 is of traditional construction including two legs 102 and 104. The leg 102 includes a marking tip 106, such as, for example, pencil lead or the like. The leg 104 includes a pointed end 108 which, for example, may be firmly held in a fixed position on, for example, a piece of paper for creating a circle of even diameter depending on the distance between the legs 102,104. The creation of a circle and use of the compass 100 is well-known in the art and will not be further described herein.

The sleeve 116 of the present invention is slidably attached to the leg 104 and may be positioned to advance to an extended position to cover the pointed end 108 when the compass 100 is not in use. The embodiment shown in FIG. 4 includes a groove 128 in the sleeve 116 with perpendicularly extending grooves 132 integrally formed therewith. The leg 104 is shown having a button 130 extending therefrom for locking within the perpendicularly extending groove 132. Preferably, a spring 124 is provided that forces the sleeve 116 into the protected position when not in use. In addition, the button 130 may be depressable into the leg 104 such that the sleeve 116 may completely extend over the pointed end 108 of the leg 104 of the compass 100.

Alternatively, the groove 128 may be lengthened such that the button 130 does not interfere with complete extension of the sleeve 116 over the pointed end 108 when not in use. While the groove 128 with perpendicularly extending grooves 132 is shown and illustrated with reference to FIG. 4, it should be understood that a similar embodiment for the sleeve 116 to FIG. 2 without perpendicularly extending grooves and without a button 130 may also be implemented. Likewise, an embodiment without grooves and similar to FIG. 1 of the present invention may also be incorporated for the sleeve 116 of the present invention.

Figure 5:
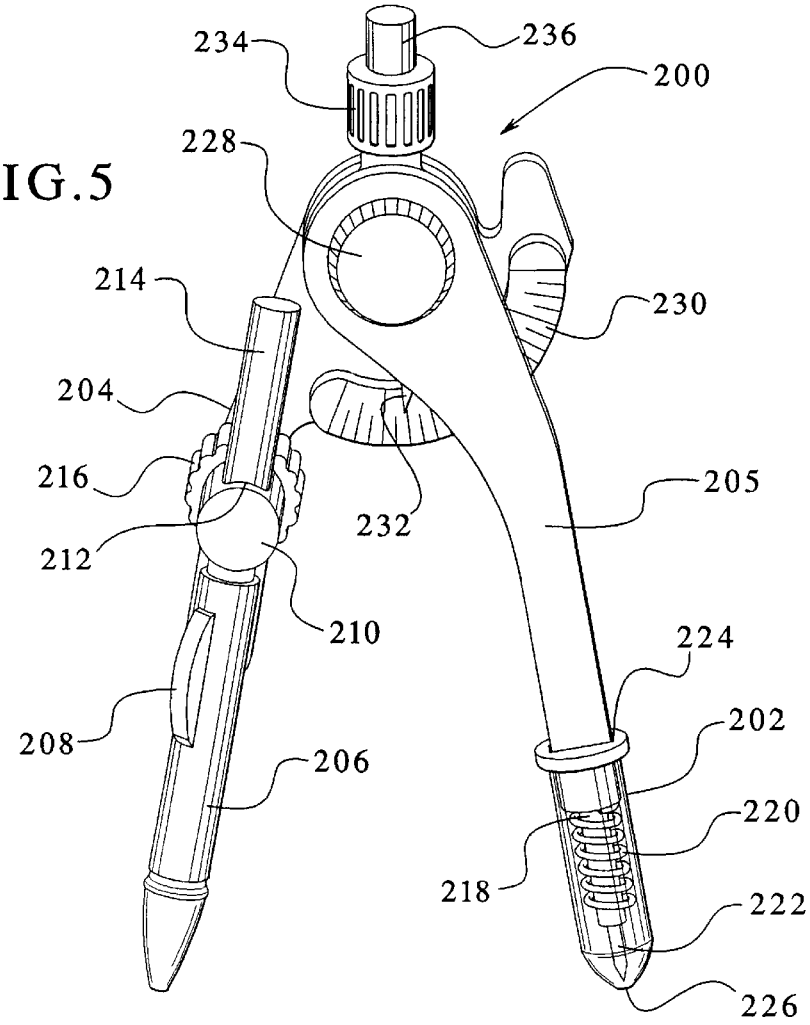
FIG. 5 illustrates a perspective view of an embodiment of a compass with a retractable shield and removable marking device in an embodiment of the present invention.

Referring now to FIG. 5, another embodiment of a compass 200 having a retractable sleeve 202 is shown and illustrated. The compass 200 may be of traditional construction and may include two legs 204,205. The leg 204 may have a marking device 206 attached thereto. Further, the marking device 206 may be a mechanical pencil or other like device for producing a mark on a marking surface. The marking device 206 may have an advancing mechanism 208 that allows a marking tip (not shown) to extend from the marking device 206 when the advancing mechanism 208 is depressed. Any device capable of producing a mark and able to be connected to the leg 204 may be utilized in this invention, such as, for example, a pencil, colored pencil, crayon, pen and/or other like devices. The marking device may also be integrally formed with the leg 204.

A fastening device 210 having an aperture 212 therethrough may be implemented to connect the marking device 206 to the leg 204. The marking device 206 may have a shaft 214 that may extend through the aperture 212 in the fastening device 210. A dial 216 may be utilized to tighten the shaft 214 of the marking device 206 inside the aperture 212 of the fastening device 210. When the dial 216 is turned, the dial 216 may provide resistance against the shaft 214 thereby locking the shaft 214 of the marking device 206 inside the aperture 212 of the cylinder 210. This invention is not meant to be limited by the fastening device as shown. Any other like fastening device may be utilized for the purpose of attaching the marking device 206 to the compass leg 204. Of course, as previously set forth, the marking device 206 may be integrally formed with the leg 204.

As indicated previously, any device capable of producing a mark and connectable to the leg 204 may be utilized as the marking device 206. The dial 216 may also be loosened to allow the shaft 214 of the marking device 206 to be removed from the aperture 212 of the fastening device 210. This may allow the marking device 206 to be changed or otherwise replaced if a different marking device is desired by the user. Further, the dial 214 may be loosened to allow the marking device 206 to be replaced upon wear or destruction. Additionally, the marking device 206 may be removed from the aperture 212 of the fastening device 210 to be refilled if the marking device 206 is depleted of lead or ink.

Alternatively, the compass 200 may have a marking device 206 attached to the leg 204 that may include different types of writing media such as, for example, different colors of lead, different colors of inks or other various types of marking media. When a particular marking device is desired, the marking device may be selected and placed into position to be utilized. The type of marking device may be selected based on the desired use of the compass 200. Any type of advancement and/or selector for a specific type of writing media of the particular marking device may be implemented by those skilled in the art.

The leg 205 may have a retractable sleeve 202 associated therewith. The retractable sleeve 202 may house a shaft 218 around which a spring 220 may be disposed. Further, an engaging pin 222 may be attached at an end of the shaft 218 or integrally formed therewith. The engaging pin 222 may engage a marking surface 250 (shown in FIGS. 6 and 7) to provide a pivot point around which the compass 200 may rotate.

The retractable sleeve 202 may have a slot 224 through which the leg 205 may be disposed. Further, the sleeve 202 may have an aperture 226 through which the engaging pin 222 may extend. The use of the retractable sleeve 202 and the engaging pin 222 is shown in detail with respect to FIGS. 6 and 7.

Still referring to FIG. 5, the compass 200 may have a fastener 228 connecting the legs 204 and 205 together. The fastener 228 allows the legs 204, 205 to open and close thereby increasing or decreasing the distance between the two legs 204, 205.

Attached to the leg 204 and disposed between the legs 204, 205 is a radius length guide 230 that provides a scale on the guide 230 having indication of a distance between the two legs 204, 205. Attached to the leg 205 may be an arrow 232 that may be used as an indicator that may be superimposed on the scale of the radius length guide 230 to identify a specific distance between the two legs 204, 205. The radius length guide 230 may be scaled in metric or English or other like measurement scale.

The compass 200 may have a knob 234 extending vertically from the compass 200. The knob 234 may be used for holding and/or spinning the compass 200 when used to draw a circle or arc on a marking surface. Attached to the knob 234 may be an eraser 236 that may be utilized for erasing mistakes or other marks created by, for example, the marking device 206.

Different components of the compass 200 may be colored distinctively to assist a user with following and remembering instructions regarding use of the compass 200 and/or to be pleasing to the eye. The compass 200 may have three different colors, such as, for example, red, blue and yellow, associated with various components of the compass 200. The different colors of the separate components may be integrated into instructions for using the compass 200 which may be included on, for example, the packaging of the compass 200.

As an example, the leg 204 and the marking device 206 may be colored blue while the leg 205 having the engaging pin 222 may be colored red. The red color on the leg 205 may, therefore, act as a warning by its color indicating that the extending pin 222 may be dangerous.

The radius length guide 230 may be a third color such as, for example, yellow. Such a color for the radius length guide 230 provides high visibility, especially when contrasted with the colors of the legs 204, 205. The arrow 232, which may be attached to the leg 205, may be the same color as the leg 205. The arrow 232 may provide a highly visible pointer when superimposed on the yellow radius length guide and may allow the measurement of the radius length to be read easily by a user of the compass 200.

Of course, the invention should not be construed to be limited in the above-identified manner. Any color combination may be utilized for the separate components of the compass 200 to aid in following and remembering user instructions and/or to be pleasing to the eye.

Figure 6:
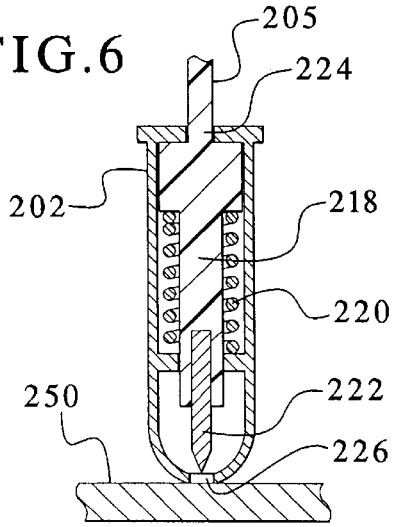
FIG. 6 illustrates a cross-sectional view of an embodiment of a retractable shield and engaging pin in an embodiment of the present invention.

Referring now to FIG. 6, a cross-sectional view of the sleeve 202 with the engaging pin 222 is shown and illustrated. The sleeve 202 may contain the shaft 218 around which may be disposed the spring 220. Attached to or integrally formed with the shaft 218 may be the engaging pin 222. The slot 224 may be disposed in the sleeve 202 for the leg 205 to be disposed therethrough. An aperture 226 may be disposed in the sleeve 202 for the engaging pin 222 to extend therethrough.

Figure 7:
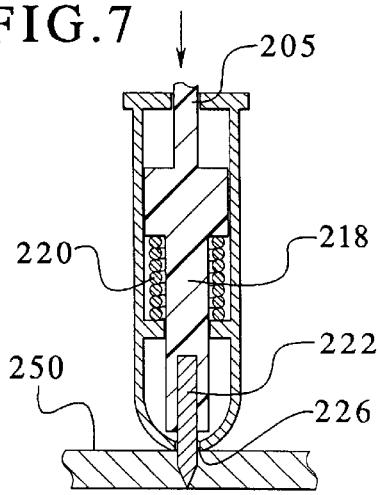
FIG. 7 illustrates a cross-sectional view of an embodiment of a retractable shield and engaging pin in an embodiment of the present invention wherein the engaging pin is engaged to a marking surface.

FIG. 6 shows the retractable sleeve 202 and engaging pin 222 resting upon the marking surface 250 without downward pressure from the leg 205. Alternatively, FIG. 7 shows downward pressure stemming from the leg 205 which advances the shaft 218 in a downward direction thereby extending the engaging pin 222 through the aperture 226 and into the marking surface 250. This allows the engaging pin 222 to provide an anchor or pivot point for the compass 200 around which the compass 200 may rotate.

When pressure is applied to the leg 205 thereby extending the engaging pin 222, the spring 220 may be compressed. When pressure is released from the leg 205, the spring 220 may extend and may slide the sleeve 202 downward thereby covering the engaging pin 222. This may allow the extending pin 222 to be housed in the sleeve 202 of the compass 200 when the compass 200 is not in use thereby decreasing the potential for injury to a person using the compass 200.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A compass assembly comprising:

a first leg and a second leg connected to pivot with respect to each other and connected at a common endpoint wherein the first leg has a marking device and further wherein the second leg has an engaging pin;

a sleeve attached to the second leg having an interior space defined by walls wherein the sleeve is extendable between a first position and a second position wherein the engaging pin of the second leg enclosed in the interior space of the sleeve in the second position; and a spring in the interior space of the sleeve capable of holding the sleeve in the second position wherein pressure applied to the second leg compresses the spring and release of pressure applied to the second leg extends the spring and slides the sleeve to the second position.

2. The compass assembly of claim 1 further comprising:

an aperture at an end of the sleeve through which the engaging pin may extend.

3. The compass assembly of claim 1 wherein the first leg is a first color and the second leg is a second color.

4. The compass assembly of claim 1 wherein the marking device is a pencil.

5. The compass assembly of claim 1 wherein the marking device is a pencil having a plurality of leads.

6. The compass assembly of claim 1 further comprising:

an eraser at the common endpoint.

7. The compass assembly of claim 2 wherein the marking device is removable from the first leg.

8. The compass assembly of claim 1 further comprising:

a connecting means for removably attaching the marking device to the first leg.

9. A system comprising:

a compass assembly having a first leg and a second leg connected to pivot with respect to each other wherein the first leg has an interchangeable marking device having a plurality of marking tips and further wherein the second leg has an engaging pin; and a sleeve having an interior space wherein the sleeve is extendable between a first position and a second position wherein the engaging pin of the second leg is enclosed in the interior space of the sleeve in the second position and further wherein a spring is provided in the interior space of the sleeve holding the sleeve in the second position such that release of pressure applied to the second leg extends the spring and slides the sleeve to the second position.

10. The system of claim 9 further comprising:

an aperture on an end of the sleeve through which the engaging pin is slidable.

11. The system of claim 9 wherein the interchangeable marking device is removably attached to the first leg.

12. The system of claim 9 further comprising:

an advancing mechanism for advancing a marking tip from the interchangeable marking device.

13. The system of claim 9 further comprising:

an eraser attached to the compass assembly.

14. The system of claim 9 wherein the marking device has a plurality of pencil leads.

15. The system of claim 9 wherein the first leg is a first color, and the second leg is a second color distinct from the first color.

16. The system of claim 9 further comprising:

a knob attached to the compass assembly.

17. A method for using a compass, the method comprising the steps of:

providing a compass assembly having a first leg and a second leg connected to pivot with respect to each other;

providing a first marking device on the first leg;

providing an engaging pin on the second leg;

providing a sleeve wherein-the sleeve is extendable between a first position and a second position wherein the engaging pin is enclosed in the sleeve in the second position;

providing a spring in the sleeve holding the sleeve in the second position;

providing a marking surface;

placing the second leg having the engaging pin on the marking surface;

applying pressure to the second leg to compress the spring; and releasing the pressure applied to the second leg to extend the spring and to slide the sleeve to the second position.

18. The method according to claim 17 further comprising the steps of:

placing the first leg having the first marking device on the marking surface; and spinning the compass to produce a mark on the marking surface.

19. The method according to claim 17 further comprising the step of:

providing a first marking device removably attached to the first leg.

20. The method according to claim 19 further comprising the step of:

removing the first marking device from the first leg; and attaching a second marking device to the first leg.

* * * * *